US006071569A

United States Patent [19]

Stambaugh

[11] Patent Number: 6,071,569

[45] Date of Patent: Jun. 6, 2000

[54] METHOD OF APPLYING SAMPLE MATERIAL TO A SUBSTRATE

[75] Inventor: Blaine C. Stambaugh, Signal Mountain, Tenn.

[73] Assignee: Arcade, Inc., New York, N.Y.

[21] Appl. No.: 09/211,804

[22] Filed: Dec. 15, 1998

Related U.S. Application Data

[62] Division of application No. 09/113,400, Jul. 10, 1998

[60] Provisional application No. 60/052,306, Jul. 11, 1997.

[51] Int. Cl.[7] ..... B05D 1/06; B05D 1/02

[52] U.S. Cl. ..... 427/421; 427/2.31; 427/180; 427/197; 427/288

[58] Field of Search ..... 427/421, 282, 427/285, 288, 2.31, 276, 180, 197

[56] References Cited

U.S. PATENT DOCUMENTS

| | | | |
|---|---|---|---|
| 2,183,711 | 12/1939 | DeWitt . | |
| 2,225,729 | 12/1940 | White | 41/29 |
| 3,478,969 | 11/1969 | Lund . | |
| 4,110,494 | 8/1978 | Schindler et al. . | |
| 4,613,542 | 9/1986 | Alexander . | |
| 4,752,496 | 6/1988 | Fellows et al. | 427/27 |
| 4,855,162 | 8/1989 | Wrasidlo et al. . | |
| 4,882,204 | 11/1989 | Tenenbaum . | |
| 4,889,755 | 12/1989 | Charbonneau . | |
| 4,890,872 | 1/1990 | Parrotta et al. . | |
| 4,925,667 | 5/1990 | Fellows et al. | 424/401 |
| 4,937,099 | 6/1990 | Hjorth . | |
| 4,940,584 | 7/1990 | Tararuj et al. . | |
| 4,950,584 | 8/1990 | Komamura et al. . | |
| 4,952,400 | 8/1990 | Tararuj et al. . | |
| 4,988,557 | 1/1991 | Charbonneau . | |
| 5,050,910 | 9/1991 | Schechter et al. . | |
| 5,072,831 | 12/1991 | Parrotta et al. . | |
| 5,503,869 | 4/1996 | Van Oort . | |
| 5,562,112 | 10/1996 | Gunderman et al. . | |
| 5,566,693 | 10/1996 | Gunderman et al. . | |
| 5,622,599 | 4/1997 | Sproule et al. | 162/186 |
| 5,953,885 | 9/1999 | Berman et al. . | |

*Primary Examiner*—Shrive Beck
*Assistant Examiner*—Jennifer Calcagni
*Attorney, Agent, or Firm*—Pennie & Edmonds LLP

[57] ABSTRACT

A sampler containing a sample material applied to a substrate with a cover over the sample material. Sample material is deposited on the substrate by spray depositing the sample material on the substrate, which causes the sample material particles to lie in a substantially flat orientation. To enable the spraying of a material, a slurry is formed by mixing the sample material with a suitable carrier. The carrier then evaporates, leaving the sample material on the substrate.

16 Claims, 1 Drawing Sheet

METHOD OF APPLYING SAMPLE MATERIAL TO A SUBSTRATE

This application is a divisional of application Ser. No. 09/113,400 filed Jul. 10, 1998, which claims priority to U.S. Provisional Application No. 60/052,306 filed Jul. 11, 1997.

FIELD OF THE INVENTION

The present invention relates generally to a sampler and a method of making the sampler. The sampler comprises an amount of material applied by non-contact spray deposition to a substrate such that the consumer may sample the material without purchasing a full size container.

BACKGROUND OF THE INVENTION

Several types of samplers are known which allow consumers to test a product before purchasing a full size container. Often, businesses such as those in the cosmetic industry obtain new customers by distributing samples of their products to potential customers. Samplers are commonly available in retail stores or are distributed in magazines or through the mail.

Samplers are well known in the art. U.S. Pat. No. 5,072,831 to Parrotta et al., for example, provides a layer of sample material on a flat, paper-stock sheet that is coated with a barrier layer. A removable, transparent cover protects the sample material and allows consumers to see the sample before opening the sampler. To apply the sample material, a user must first rub it off the sampler with her finger.

The application of non-waxy powder materials to the sampler substrate presents special problems. Powder materials, such as may be found in cosmetics, are composed of dry particulate matter and must present a dry, non-oily appearance when applied to the user's skin.

U.S. Pat. Nos. 4,752,496 and 4,925,667 to Fellows et al., disclose cosmetic samplers for use in direct mailers or magazines where a cosmetic slurry containing a cosmetic, a carrier and a film forming agent is printed onto a substrate. The liquid carrier then evaporates leaving the cosmetic adhered to the substrate. U.S. Pat. No. 5,562,112 to Gunderman et al., discloses a similar invention wherein a slurry containing a cosmetic, a carrier and a binder is printed onto a substrate and covered with a thin film overlay.

One problem encountered in preparing samplers for powder cosmetics and other dry particulate materials is adhering the powder or other particulates to each other and to the substrate. This problem has been overcome in the art by the use of "binders" which cause the particulates to stick to each other and to the substrate. In many cases, however, binders are not used in the product itself, and thus the use of binders in the samplers changes the attributes of the sample material. In some cases the essential characteristics of the sample are no longer the same as the product. Such a sample is useless to a potential consumer.

Conventional application methods include such processes as screen printing, flexographic and engraved roll printing. These processes apply the sample material by positive pressure of a printing roll or screen pressing the sample admixture onto the substrate. When the substrate is removed from the roll or screen, the sample is pulled in opposite directions by the roll and the substrate. This effect disturbs the density packing of the sample material by weakening the cohesive bonds between the sample material and the substrate limiting the thickness of the sample material layer that may be applied. As a result, the amount of sample material that may be applied using conventional methods is too little to allow the consumer to adequately evaluate the suitability of the sample material.

Printing of attractive designs with a dry cosmetic is particularly problematic. Current printing methods require that rollers or screens used in the printing process be inscribed or cut with the pattern to be printed on the substrate. In the event of a change of pattern or a decision to make the layer of sample material thicker, expensive reconfiguring of the printing presses must be undertaken. Further expense and inconvenience results from the time taken to change and reconfigure the printing process to meet the new printing requirements.

Current methods of application do not permit multiple layers of sample material to be applied to the substrate. As previously described, the density packing of sample material is disturbed when the screen or roller separates from the material deposit. Application of multiple layers presents the same problem. Printing another layer of sample material using conventional methods would require additional binders or films or would result in the deposit falling off the substrate.

SUMMARY OF THE INVENTION

One object of the invention is to provide a disposable sampler.

Another object of the invention is to provide a disposable sampler which does not use binders or other oil/wax based additives or films to cause the sample material to adhere to the substrate.

Yet another object of the invention is to provide a sampler which is easily adaptable to printing designs of various shapes, thicknesses, and multiple layers on various types of substrates.

According to the invention, a sampler comprises a sample material slurry spray deposited on a substrate. The slurry comprises an admixture of a sample material and a carrier. The sample material may be a cosmetic, medicated powder, powder, cream, lipstick or fragrance or other material. The carrier is preferably a non-viscous, quick drying solvent that is compatible with the sample material. The admixture is applied to the substrate through an atomization spray nozzle preferably a high volume, low pressure (HVLP) spray atomizer or other suitable atomizer. The sample material slurry impinges on the surface of the substrate. The impact of impingement of powders tends to cause the powder particles to lie flat on the substrate and on each other, and this flat orientation of particles provides for greater adherence of the particles to the substrate and to each other. The carrier subsequently evaporates, leaving behind the sample material on the substrate.

This sampler and method of application eliminate the need for binders or other additives to adhere the sample material particles to each other and to the substrate. The invention further eliminates the need for special substrates and permits pattern printing of the sample material quickly and economically.

BRIEF DESCRIPTION OF THE DRAWINGS

Reference is next made to a brief description of the drawings, which are intended to illustrate the sampler according to the present invention. The drawings and detailed description which follow are intended to be merely illustrative, and are not intended to limit the scope of the invention as set forth in the appended claims.

DETAILED DESCRIPTION OF THE PREFERRED EMBODIMENTS

Figure 1A:
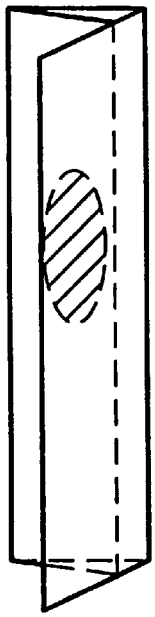
FIG. 1A shows a preferred embodiment wherein the cover is made by folding the substrate over the sample material deposit.

According to the present invention, a sample material slurry is applied to a substrate by means of spray deposition. The slurry comprises an admixture of a sample material and a carrier compatible with the sample material. The sample material may preferably be a cosmetic, medicated powder, powder cosmetic, or most preferably a microencapsulated material, such as a fragrance.

The carrier is a non-viscous, quick drying solvent that is compatible with the sample material. Preferably, the carrier is the least toxic solvent practicable. Most preferably the carrier is isopropyl alcohol or ethanol. Occasionally, according to the characteristics of the sample material, water may be introduced to the slurry to improve wetting and particle suspension. Most preferably, the amount of water introduced should not exceed approximately 1% by volume of the carrier.

The substrate of the invention may be a continuous web for use in large scale printing processes. Useful materials include paper, paper board, card stock, cover stock, film, foil, laminates, composite sheet or flocked sheet. Preferred substrates include clear, printed or opaque PET, C2S paper, uncoated paper, synthetic paper, embossed, debossed, and microembossed paper or paper having raised features. The substrate may be oil impermeable, but this is not required. Most preferably, the web is a flat, continuous, substantially smooth sheet capable of use in a commercial printing apparatus.

The spray deposition technique according to the present invention has several unexpected advantages over conventional techniques. Spray deposition applies materials, including waxy cosmetics such as lipstick, dry, powdered cosmetics, microencapsulated fragrances, and other materials onto a substrate or printing web without binders. The spray deposit technique impinges the sample material onto the surface of the substrate in such a way that frictional forces hold the sample material in place on the substrate, without the use of binders, oils, or films. Preferably, the sample material is a powder, and this spray deposit technique causes the powder particles to lie in a substantially flat or planar orientation. Powder particles are generally flat, having two opposing surfaces, and in the flat orientation, the two opposing surfaces of each particle are generally parallel to the surface of the substrate. Powder particles lying in such an orientation adhere remarkably well to the substrate and to each other.

This technique minimizes the presence of components other than the ingredients of the sample material, which may perhaps adulterate or alter the sampler material, thereby providing for sample material having a chemical composition which is substantially identical to that sold in consumer sizes. The sampler of the present invention therefore better represents the product, and will likely be more successful in attracting consumers to purchase the product. In addition, because the sample material is deposited in a non-contact manner, thicker layers of the sample material may be deposited on the sampler. In fact, this method effectively eliminates prior limits to the thickness of the sample material which may be deposited. Thicknesses of up to ⅛ inch may be obtained. This technique also enables multiple layers, i.e., one layer on top of another, to be applied to produce different effects, such as, in the case of cosmetics, color on color, pearlescence, or opacifying particles on top of color. Also, attractive designs can be formed on the substrate that are less expensive, and quickly changed or altered. Using spray deposition, patterns on the substrate are formed easily by use of stenciled patterns die cut on inexpensive materials. Lastly, because the spray technique can apply to uneven surfaces, the variety of substrates that may be used according to the present invention is greatly increased. For example, cosmetics can now be applied to such uneven surfaces as flocked paper, velvet, porous woven and unwoven surfaces and felt-like substrates.

In a preferred embodiment, a powder cosmetic is mixed with the carrier to form a slurry. Preferably, the cosmetic to carrier ratio is between about 2:1 to 0.6:1, more preferably the ratio is between about 1.5:1 to 1:1, and most preferably the ratio is about 1.2:1. The slurry is then fed into a tank capable of maintaining positive pressure to a feed pump, most preferably 11 psig. The feed pump should be capable of pumping a viscous slurry to an atomizer at various feed rates. The total amount of cosmetic applied to the substrate is proportional to the slurry feed pump rate, i.e., a higher rate will produce a thicker layer.

The slurry is applied to the substrate by an atomizer. Preferably an air atomizer is used, however, those skilled in the art will recognize that other types of atomization are equally applicable. A preferred atomizer is a HVLP (high volume, low pressure) type air atomizer, most preferably an Accuspray® Model 55 Automatic HVLP gun. The air feed pressure to the atomizer is most preferably between about 4 psig to about 6.5 psig but may vary according to the atomizers specifications.

The tip of the atomization nozzle does not make contact with the substrate and should maintain a sufficient distance from the substrate. The distance between the nozzle and the substrate will depend on the desired characteristics of the sample deposit. This distance will range between approximately 0.5 inches to approximately 5 inches. A preferred range is between approximately 1.25 inches to 3 inches. The greater the distance, the wider the application but the thinner the deposit of cosmetics. Of course, one of skill in the art will recognize that using more than one nozzle can effect a wider application and maintain the thickness of the sample. To deliver a uniform, solid coat of cosmetic on a continuous printing press with one spray nozzle, the maximum web speed is between about 400 fpm to about 600 fpm.

In a preferred embodiment of the product, the cosmetic is spray deposited onto the substrate according to the previously described process to produce a pattern on the substrate. The pattern is produced by laying a die cut stencil on top of the substrate and moving the substrate through the atomized particle stream of the sample slurry. To ensure the pattern image is clear, the stencil must be kept in close contact with the substrate.

The substrate with the sample material deposit should then be covered prior to distributing so as to eliminate off-set of the deposit. Many covers are known in the art including transparent materials such as clear plastic or glassine covers, which have the advantage of permitting the consumer to view the contents of the sample.

Figure 2:
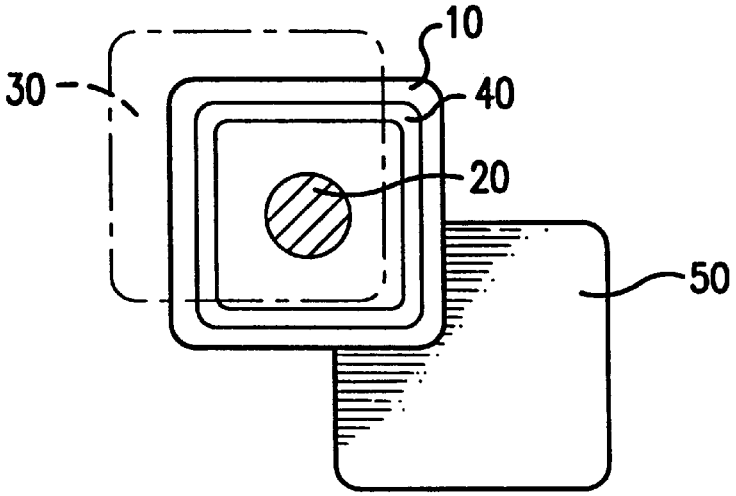
FIG. 2 represents a top view of a preferred embodiment of the sampler showing the substrate 10, the sample material 20, and the cover 30.

FIG. 2 shows the clear cover 30, on top of the sample 20 attached by adhesive 40. In this embodiment, the substrate

Figure 1B:
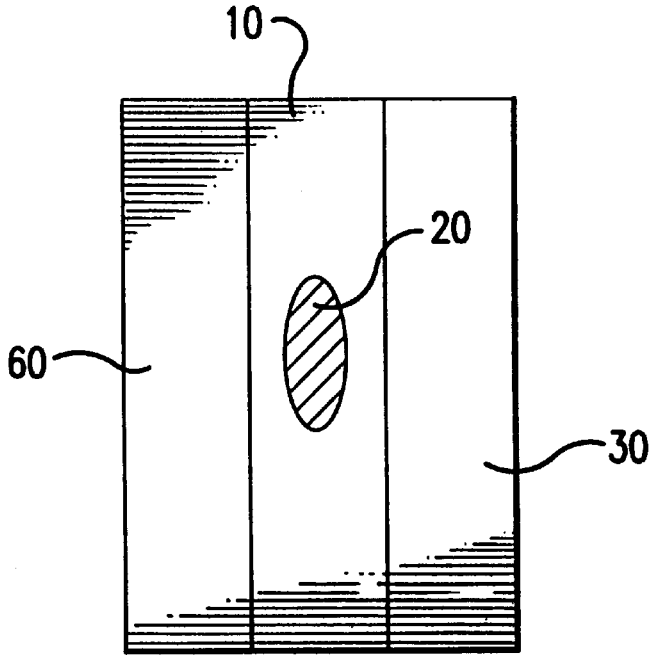
FIG. 1B shows the same preferred embodiment unfolded.

10 is attached to a hard backing 50. As shown in FIGS. 1A and 1B, the web or substrate 30 and 60 may be folded over the sample 20 to form a cover 30 and 60. The cover will protect against off-set of the product.

These variations are offered by way of example and not limitation, as it will be readily apparent to those in the art that other variations of this sampler and process for applying materials to a substrate are possible.

What is claimed:

1. A method of applying a sample material selected from the group consisting of a cosmetic, a medicated powder, a powder cosmetic, and a microencapsulated material, to a substrate comprising the following steps:

(a) preparing a slurry comprising the sample material and a carrier, wherein the slurry is substantially free of binders, oils, and films;

(b) spraying said slurry onto a surface of the substrate with an air feed pressure in the range from about 4 psig to about 6.5 psig; and (c) removing substantially all of the carrier.

2. The method of claim 1, wherein the carrier is a non-viscous, quick drying solvent that is compatible with the sample material.

3. The method of claim 2, wherein said carrier is selected from the group consisting of isopropyl alcohol and ethanol.

4. The method of claim 2, wherein the step of removing substantially all of the carrier comprises allowing the carrier to evaporate.

5. The method of claim 1, wherein the slurry also contains water.

6. The method of claim 5, wherein the amount of water in the slurry does not exceed approximately 1% by volume of the carrier.

7. The method of claim 1, wherein the ratio of sample material to carrier is between about 2:1 to about 0.6:1.

8. The method of claim 7, wherein the ratio of sample material to carrier is between about 1.5:1 to about 1:1.

9. The method of claim 8, wherein the ratio of sample material to carrier is about 1.2:1.

10. The method of claim 1, wherein the step of spraying the slurry is performed by an air atomizer.

11. The method of claim 1, wherein the substrate surface is uneven.

12. The method of claim 1, wherein the substrate is selected from the group consisting of paper, paper board, card stock, cover stock, film, foil, laminates, composite sheet, flocked sheet, clear, printed or opaque PET, C2S paper, uncoated paper, synthetic paper, embossed, debossed, or microembossed paper, and paper having raised features.

13. The method of claim 1, further comprising the step of removably attaching a cover to the substrate over the sample material.

14. The method of claim 1, wherein the slurry is sprayed onto the substrate through a stencil.

15. A method of applying a sample material to a substrate comprising the following steps:

(a) preparing a slurry comprising a powder cosmetic and a carrier, wherein the powder cosmetic to carrier ratio is about 2:1 to about 0.6:1 and wherein the slurry is substantially free of binders, oils, and films;

(b) applying the slurry to the substrate by a stationary high volume, low pressure air atomizer having a spray nozzle maintained between about 0.5 inches to about 5 inches from the substrate, wherein the substrate comprises a continuous web moving at a maximum speed of about 600 fpm past the spray nozzle; and (c) removing substantially all of the carrier by allowing the carrier to evaporate.

16. The method of claim 15, wherein the substrate comprises a continuous web moving at a maximum speed of 400 fpm past the spray nozzle.

* * * * *